US008191276B1

(12) United States Patent
Yi

(10) Patent No.: US 8,191,276 B1
(45) Date of Patent: Jun. 5, 2012

(54) GOLF BALL LINER

(76) Inventor: Jung Kyun Yi, Haymarket, VA (US)

( * ) Notice: Subject to any disclaimer, the term of this patent is extended or adjusted under 35 U.S.C. 154(b) by 0 days.

(21) Appl. No.: 13/084,918

(22) Filed: Apr. 12, 2011

(51) Int. Cl.
*G01B 3/14* (2006.01)
*B25B 5/14* (2006.01)

(52) U.S. Cl. ..... 33/562; 33/565

(58) Field of Classification Search ..... 33/562, 33/565

See application file for complete search history.

(56) References Cited

U.S. PATENT DOCUMENTS

| | | | | |
|---|---|---|---|---|
| 3,797,123 | A * | 3/1974 | Fraley | 33/501 |
| 4,385,447 | A * | 5/1983 | Bennett | 33/501 |
| 5,878,659 | A * | 3/1999 | Hatter | 101/35 |
| 6,082,015 | A * | 7/2000 | Bjorkdahl | 33/555.2 |
| 6,179,732 | B1 * | 1/2001 | Inoue et al. | 473/409 |
| 6,676,544 | B2 * | 1/2004 | Tyke | 33/574 |
| 7,047,877 | B2 | 5/2006 | Powney et al. | |
| 7,299,685 | B1 * | 11/2007 | Burnett | 73/65.02 |
| 7,568,294 | B2 * | 8/2009 | Sung | 33/562 |
| 2002/0005124 | A1 * | 1/2002 | Parks | 101/127 |
| 2008/0271333 | A1 * | 11/2008 | Sung et al. | 33/562 |
| 2008/0271334 | A1 * | 11/2008 | Sung | 33/562 |
| 2009/0054178 | A1 * | 2/2009 | Perry | 33/574 |

FOREIGN PATENT DOCUMENTS

| | | | |
|---|---|---|---|
| KR | 20-0317678 | Y1 | 6/2003 |
| KR | 20-0424169 | Y1 | 8/2006 |
| KR | 10-0621844 | B1 | 9/2006 |
| KR | 10-2010-0054960 | A | 5/2010 |

OTHER PUBLICATIONS

English Abstract of KR10-0621844.
English Translation of KR10-2010-0054960.

* cited by examiner

*Primary Examiner* — Yaritza Guadalupe-McCall
(74) *Attorney, Agent, or Firm* — The PL Law Group, PLLC

(57) ABSTRACT

The golf ball liner includes a fixing member having a predetermined shape to house a golf ball, and including fixing pads disposed at both ends of the fixing member to hold the golf ball not to move, a rotating member having a shape identical to that of the fixing member and a diameter smaller than that of the fixing member, and including both ends rotatably supported by the respective ends of the fixing member, and at least one pen disposed at an inner side of the rotating member to contact the golf ball for drawing a line on a surface of the golf ball along a circumference of the golf ball when the rotating member rotates around the golf ball.

18 Claims, 7 Drawing Sheets

GOLF BALL LINER

BACKGROUND

1. Field of the Invention

The present invention relate to a golf ball liner.

2. Description of Related Art

In general, golf is a game of power and direction. Many golf players have been studied in order to determine how to send a golf ball accurately to a target in any condition. One of the well-known and simple methods is drawing a line on the surface of a golf ball According to golf rules a golf player has a limited number of opportunities to align a golf ball in one hole. For example, a golf player is allowed to align a golf ball only on a tee box for a tee shot and only on a green for putting.

A golf player generally aligns a golf ball to a virtual straight line to the target in order to send the golf ball accurately to the target. As one of the methods for aligning a golf ball, a golf player draws a line on a surface of the golf ball along the circumference of the ball to help the golf player aim in the direction of the target area.

For example, when a golf player hits a golf ball using a golf club the line on the golf ball helps the golf player to aim the target accurately.

A golf player on the green may also align a golf ball to a hole-cup based on a line drawn on the golf ball. The golf player uses the line on the golf ball as a hitting point when impact is made on the golf ball with a putter.

Accordingly, a line clearly and accurately drawn on the surface of a golf ball may provide mental stability and induce accurate impact thereby improving the score of a player.

Since, in general, the golf game is played with four players it is difficult for each player to distinguish his or her own ball from the others'. A line drawn on a golf ball may help the golf player to distinguish the golf balls.

It is difficult to accurately and clearly draw a line on a golf ball because of its dimpled surface.

The dimpled surface exists in order to send the golf ball higher and farther.

Accordingly, a specific tool such as a golf ball liner has been introduced. The golf ball liner helps a user draw a straight line accurately and clearly on the dimpled surface of a golf ball having.

In general, a typical golf ball liner is formed in a globular or hemispherical shape and includes a groove. After putting the golf ball inside the golf ball liner, the user draws a line along the groove.

Such golf ball liner requires a user to prepare a pen. Furthermore, the user will need to turn the golf ball liner around the golf ball after drawing a line on part of the golf ball in order to complete the line along the circumference.

Since the user needs to turn the golf ball liner, it is not easy to draw a straight line accurately. A crooked line may negatively influence a player.

In order to overcome such drawbacks, an apparatus marking a center-line on a golf ball was disclosed in Korean Patent Utility Model 20-0317678. The user puts a pen at a pen-holding groove formed at a lower part of a Y-shaped body. After fixing the pen 122 in the pen-holding hole, a user turns the golf ball to draw a straight line on its surface.

However, it is difficult to manage the apparatus marking a center line on a golf ball because the pen and the apparatus are separate. Furthermore, it is not easy to draw a straight line because a user must turn the golf ball himself. Therefore, the golf ball may be unintentionally moved crookedly when a user turns the golf ball. Such unintentional movement ruptures the integrity of the line.

Furthermore, the golf ball has dimples and may have an irregular surface. When the golf ball has an irregular surface, it is difficult to easily and clearly draw a line on the irregular surface of the golf ball with the conventional golf liners.

SUMMARY

In accordance with embodiments, a golf ball liner includes a fixing member having a predetermined shape to house a golf ball, and including fixing pads disposed at both ends of the fixing member to hold the golf ball not to move, a rotating member having a shape identical to that of the fixing member and a diameter smaller than that of the fixing member, both ends of the rotating member inserted between the fixing member and the fixing pads, the rotating member rotatably supported by the respective ends of the fixing member, at least one pen disposed at an inner side of the rotating member to contact the golf ball for drawing a line on a surface of the golf ball along a circumference of the golf ball when the rotating member rotates around the golf ball, and an elastic member disposed between the pen and the rotating member to presses the pen toward the golf ball positioned in the golf ball liner, wherein the elastic member is compressed when the golf ball is positioned in the golf ball liner, and a degree of the compression of the elastic member varies according to a shape of a surface of the golf ball to makes the pen continuously contact the surface of the golf ball.

The golf ball liner may further include an ink pad disposed inside the rotating member, and the ink pad supplies one of color ink and black ink to the pen.

The golf ball liner may further include an ink pad disposed inside the pen to supply ink to the pen.

The elastic member may be positioned between the ink pad and the rotating member.

The elastic member may be a coil spring.

The pen may include one end formed in a shape of cone.

The pen may be rotatably supported by the rotating member and include one side formed in a shape of a line.

The pen may have a head positioned outside of the golf ball liner, and the head has a groove.

The golf ball liner may further include lubricating pads between the fixing member and the rotating member and between the rotating member and the fixing pad.

The fixing pads may be made of rubber material having elastic property to tightly hold the golf ball.

The fixing member and the rotating member are made of transparent synthetic resin.

The fixing pads may form a relatively wide entrance side and a relatively narrow opposite side to easily put the golf ball inside the golf ball liner and to easily take out of the golf ball from the golf ball liner.

The golf ball liner may further include protrusions formed on an outer surface of the rotating member for preventing sliding.

According to an aspect of the present invention, a golf ball liner includes a fixing member to hold the golf ball not to move; a rotating member rotatably attached to the fixing member; a pen disposed at an inner side of the rotating member to contact the golf ball for drawing a line on a surface of the golf ball along a circumference of the golf ball when the rotating member rotates around the golf ball; and an elastic member disposed between the pen and the rotating member to presses the pen toward the golf ball positioned in the golf ball liner, wherein the elastic member is compressed when the golf ball is positioned in the golf ball liner, and a degree of the compression of the elastic member varies according to a shape of a surface of the golf ball to makes the pen continuously contact the surface of the golf ball.

DETAILED DESCRIPTION

The advantages, features and aspects of the invention will become apparent from the following description of the embodiments with reference to the accompanying drawings, which is set forth hereinafter.

Figure 1:
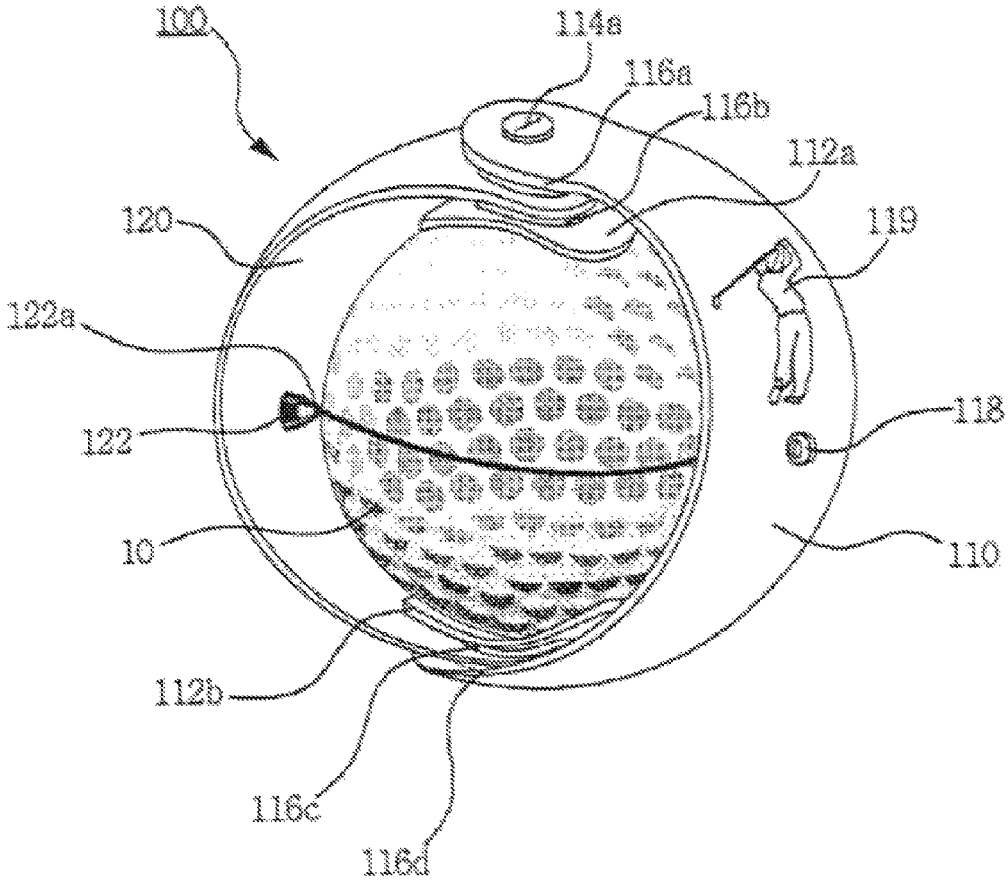
FIG. 1 is a perspective view of a golf ball liner according to embodiments.
Figure 2:
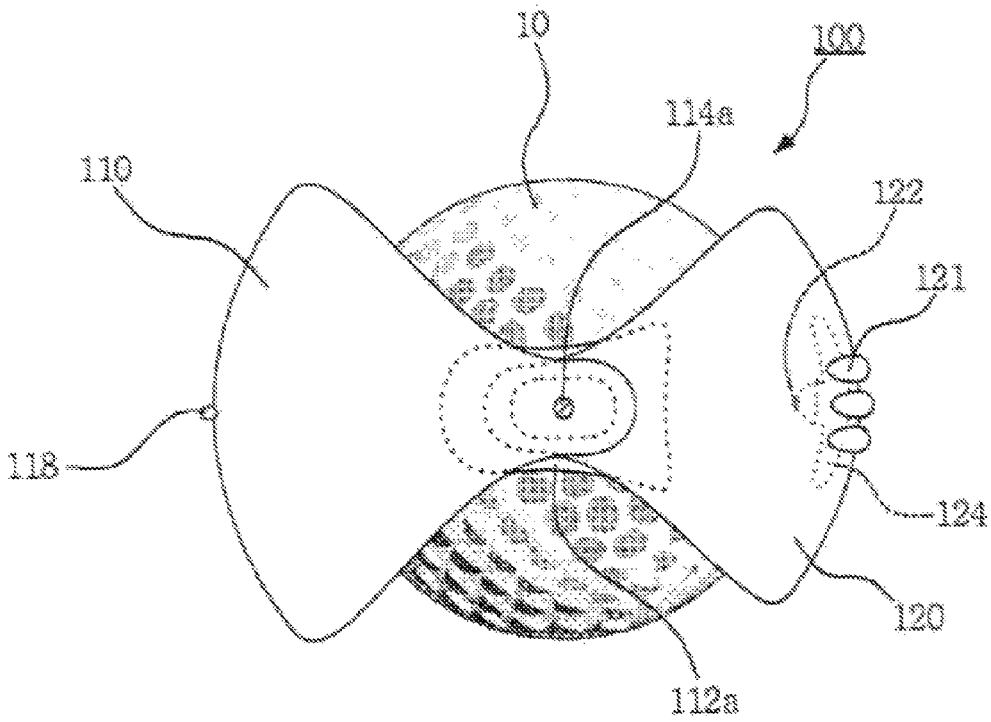
FIG. 2 is a plan view of a golf ball liner according to embodiments.

FIG. 1 is a perspective view of a golf ball liner according to embodiments. FIG. 2 is a plan view of a golf ball liner according to embodiments.

Referring to FIGS. 1 and 2, the golf ball liner 100 includes a fixing member 110 and a rotating member 120. The fixing member 110 holds the golf ball 100 in place. The rotating member 120 rotates along the surface of the golf ball 100 and includes a pen 122 for drawing a line along a circumference of the golf ball. The rotating member 120 may be integrally formed with the pen 122.

The fixing member 110 is formed in a hemispherical, fan shape and supports the rotating member 120 disposed inside the fixing member 110. The fixing member 110 includes fixing pads 112*a* and 112*b* for securing the golf ball 10 so that it does not move.

The rotating member 120 is formed in a hemispherical, fan shape and may be smaller than the fixing member 110 and be rotatably disposed inside the fixing member 110. The rotating member 120 includes protrusions 121 formed on the outer surface of the rotating member 120 in order to prevent a user's finger from sliding when he or she turns the rotating member 120. The fixing member 110 and the rotating member 120 may be formed in a "⊂" shape that has one side open.

The rotating member 120 and the pen 122 may be integrally formed. The pen 122 includes on one end 122*a* protruding from one inner side of the rotating member 120 in order to draw a straight line on the surface of the golf ball 10. Both ends of the rotating member 120 may be connected to both ends of the fixing member 110. The rotating member 120 revolves on the both ends of the axis of rotation. While the rotating member 120 revolves, the pen 122 contacts the surface of the golf ball 100 and draws a straight line on the surface of the golf ball 100.

Figure 5A:
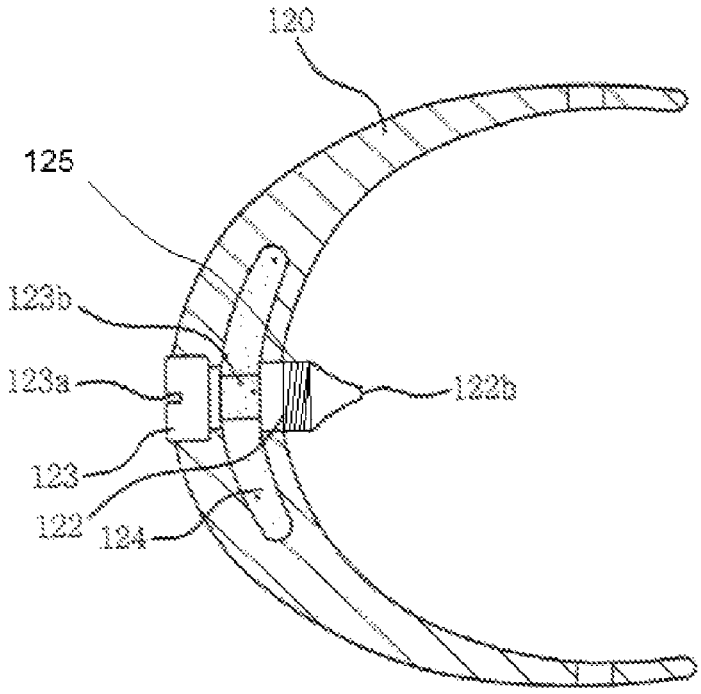
FIGS. 5A and 5B are diagrams that illustrate a rotating pen according to embodiments.
Figure 5B:
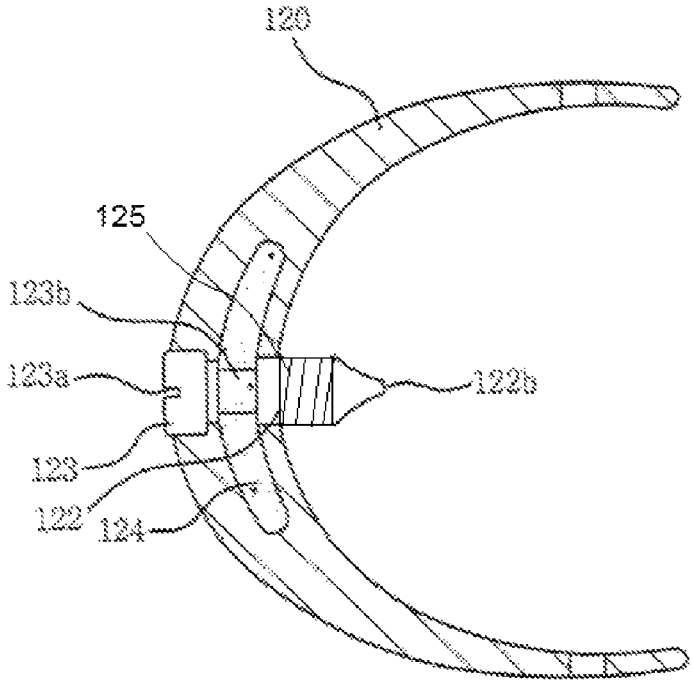
Figure 6:
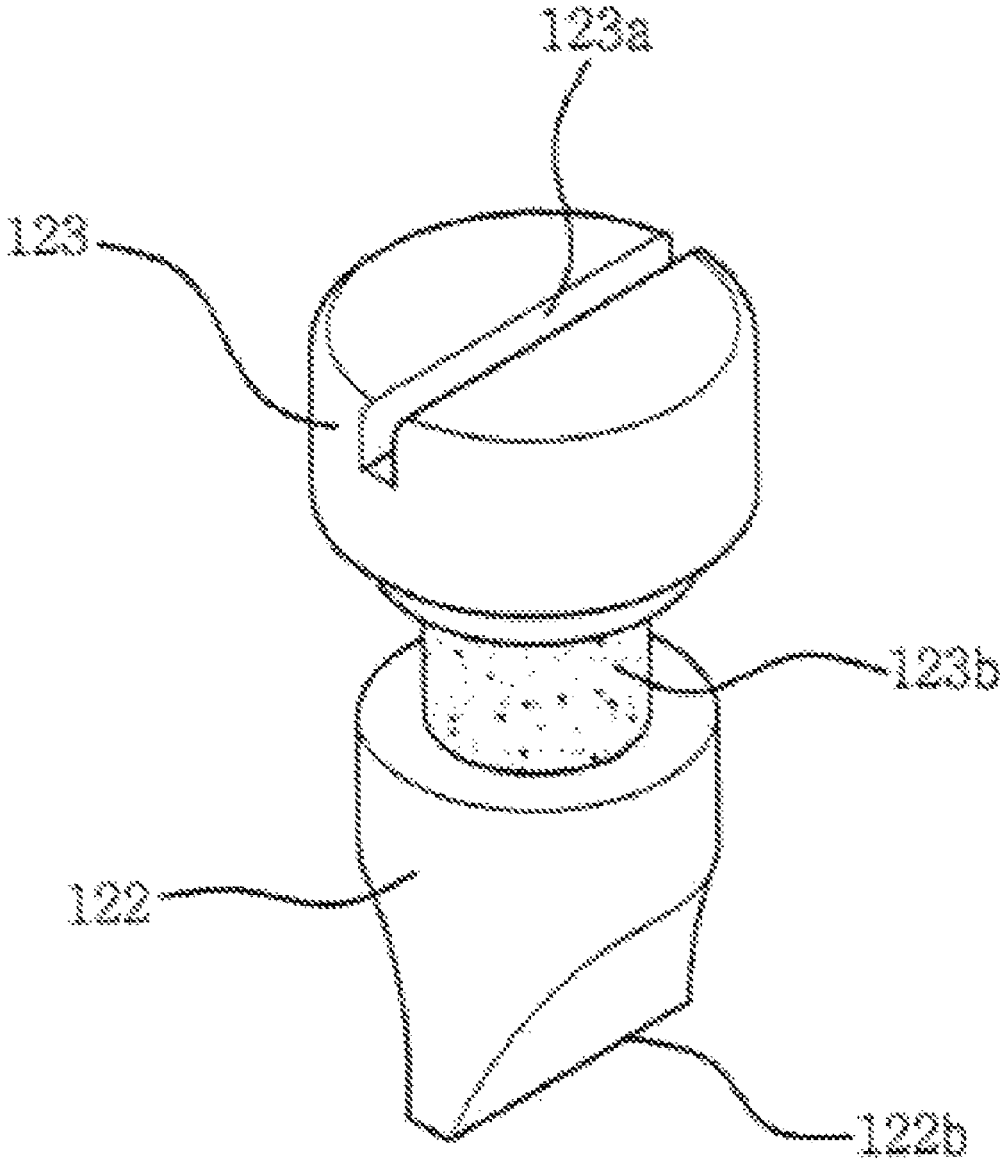
FIG. 6 is a perspective view of the pen of FIGS. 5A and 5B.

The pen 122 is rotatably disposed on the rotating member 120. In order to easily rotate the pen, a head 123 of the pen 122 includes a groove. FIGS. 5A, 5B and 6 illustrate the groove formed on the head 123.

For example, the pen 122 includes one end 122*a* formed in a cone shape. A cap 126 is openably disposed at the pen 122. The cap 126 prevents the ink from evaporating.

More than one pen 122 may be integrally formed with the rotating member 120. For example, the rotating member 120 may include two pens. A user may want to draw two lines on the surface of the golf ball 10. In this case, the rotating member 122 with the two pens satisfies such a demand.

Figure 3A:
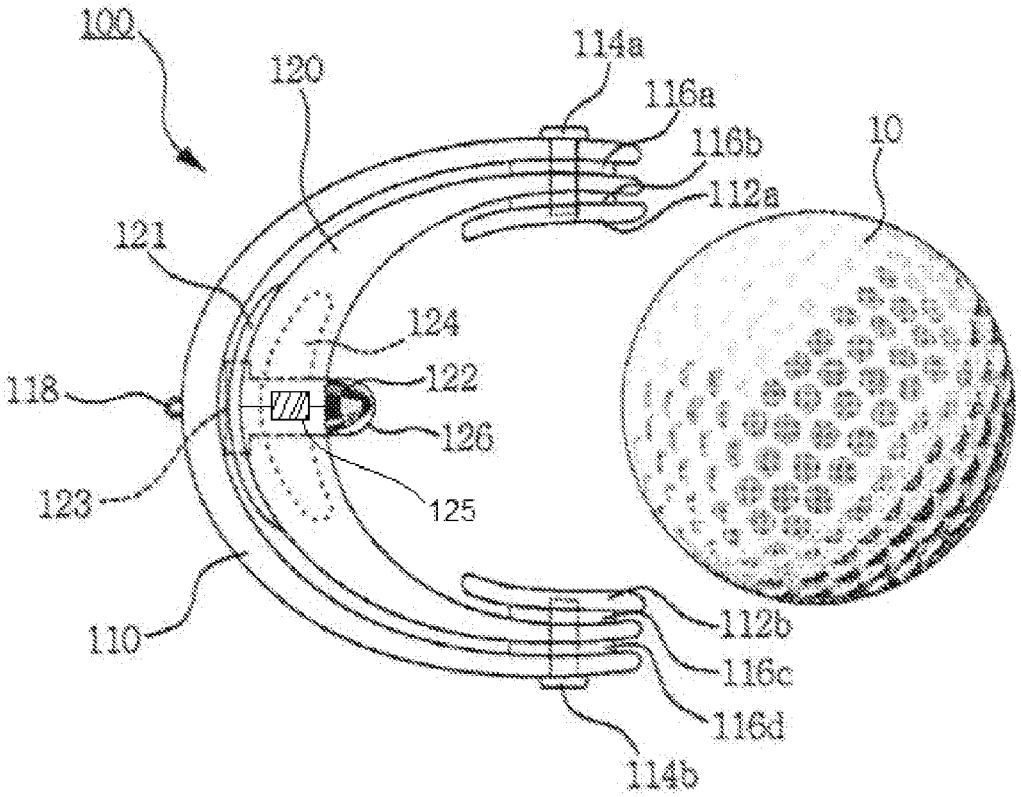
FIGS. 3A and 3B are diagrams that illustrate the golf ball liner of FIG. 1 before inserting the golf ball according to embodiments of the present invention.

The rotating member 120 includes an ink pad 124 inside the rotating member 120 to supply ink to the pen 122 as shown in FIG. 3A. A user may select the desired color to draw a line by charging the ink pad 124 with the desired color.

Figure 3B:
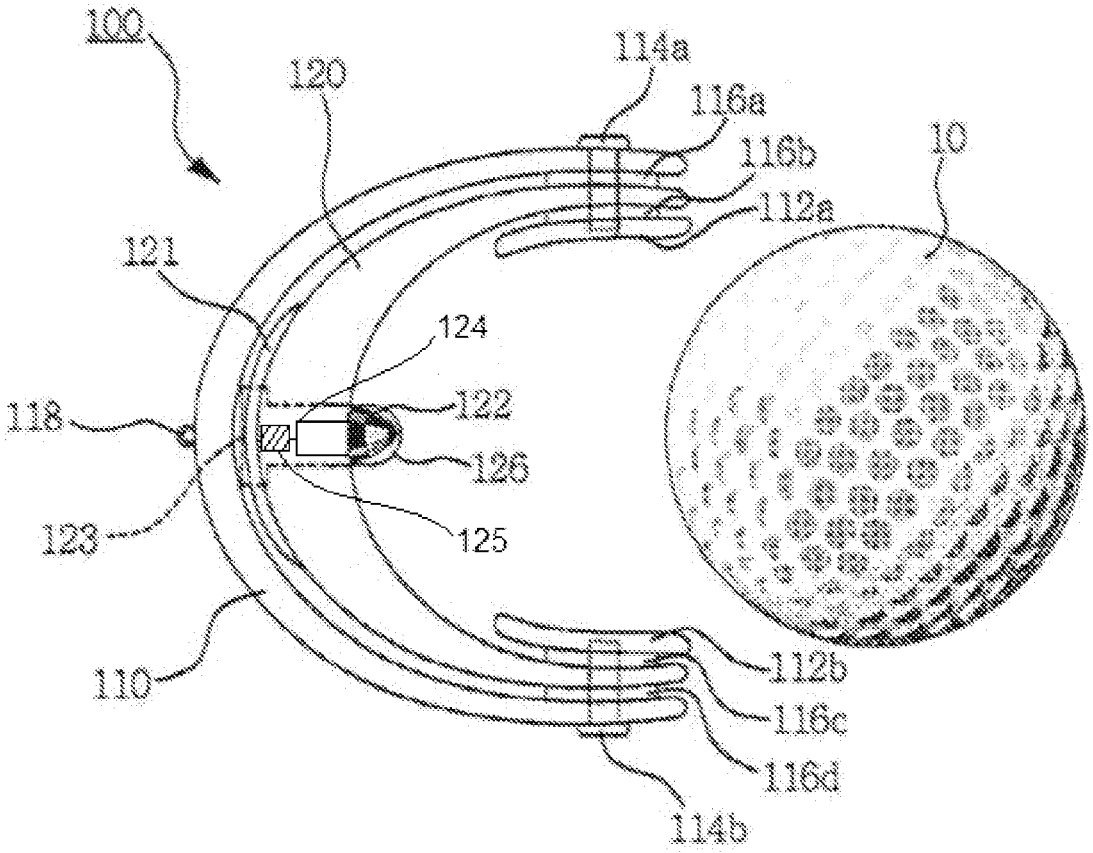

Alternatively, the ink pad 124 may be disposed insider the pen 122 as shown in FIG. 3B.

An elastic member is provided to provide an elastic property. For example, as shown in FIGS. 3A and 3B, a coil spring 125 as an elastic member is disposed to adjust a degree of a protrusion of the pen 122 from the inner surface of the rotating member. The coil spring 125 is a compression spring. The coil spring 125 presses the pen 122 toward the golf ball positioned in the golf ball liner. When the golf ball is positioned in the golf ball liner, the coil spring 125 is compressed. Even when the golf ball has an irregular surface, the golf ball liner easily and clearly draw a line even on the irregular surface of the golf ball because the coil spring 125 presses the pen toward the golf ball. That is, even when the distance between the golf ball liner and the surface of the golf ball varies, the movement of the coil spring 125 makes the pen 122 continuously contact the surface of the golf ball so that the golf ball liner is able to easily and clearly draw a line even on the irregular surface of the golf ball.

The fixing member 110 and the rotating member 120 may be made of synthetic resin. In this case, the fixing member 110 and the rotating member 120 may have elastic properties. Accordingly, a user may easily put a golf ball 10 in the golf ball liner 10. For example, the fixing member 110 and the rotating member 120 may be made of transparent synthetic resin. Therefore, a user may see whether a line is accurately drawn on the surface of the golf ball 100 when the rotating member 120 rotates.

The fixing pads 112*a* and 112*b* may be fixed at the connected ends of the fixing member 110 and the rotating member 120 through fixing pins 114*a* and 114*b*. The fixing pins 114*a* and 114*b* are not protruded towards the inside of the fixing pads 112*a* and 112*b*. Accordingly, the fixing pads 112*a* and 112*b* secure the golf ball 10 so that the line may be drawn.

Lubricating pads 116*a*-116*d* may be disposed between the fixing member 110 and the rotating member 120 and between the rotating member 120 and the fixing pads 112*a* and 112*b*. Accordingly, the lubricating pads 116*a*-116*d* enable the rotating member 120 to smoothly rotate while the fixing pads 112*a* and 112*b* are firmly tightened. In this case, any commercialized lubricating pad may be used as the lubricating pads 116*a*-116*d*.

The fixing pads 112*a* and 112*b* are formed of rubber material and disposed to face each other. Further, the fixing pads 112*a* and 112*b* form a relatively wide entrance side and a relatively narrow opposite side. Due to the elastic property of the rubber material, a user may easily put the golf ball 10 into the golf ball liner and the fixing pads 112*a* and 112*b* will hold the golf ball 10 securely.

The golf ball liner 100 may include a hook 118 on the outside of the fixing member 110 in order to allow the user to hang the golf ball liner 10 on a golf bag or carry it as he so chooses.

The golf ball liner 100 according to the embodiments may include an advertisement display unit 119 at the fixing member 110 and the rotating member 120. The advertisement display unit 119 may provide a space for logos to be printed on the golf ball 100.

Figure 4:
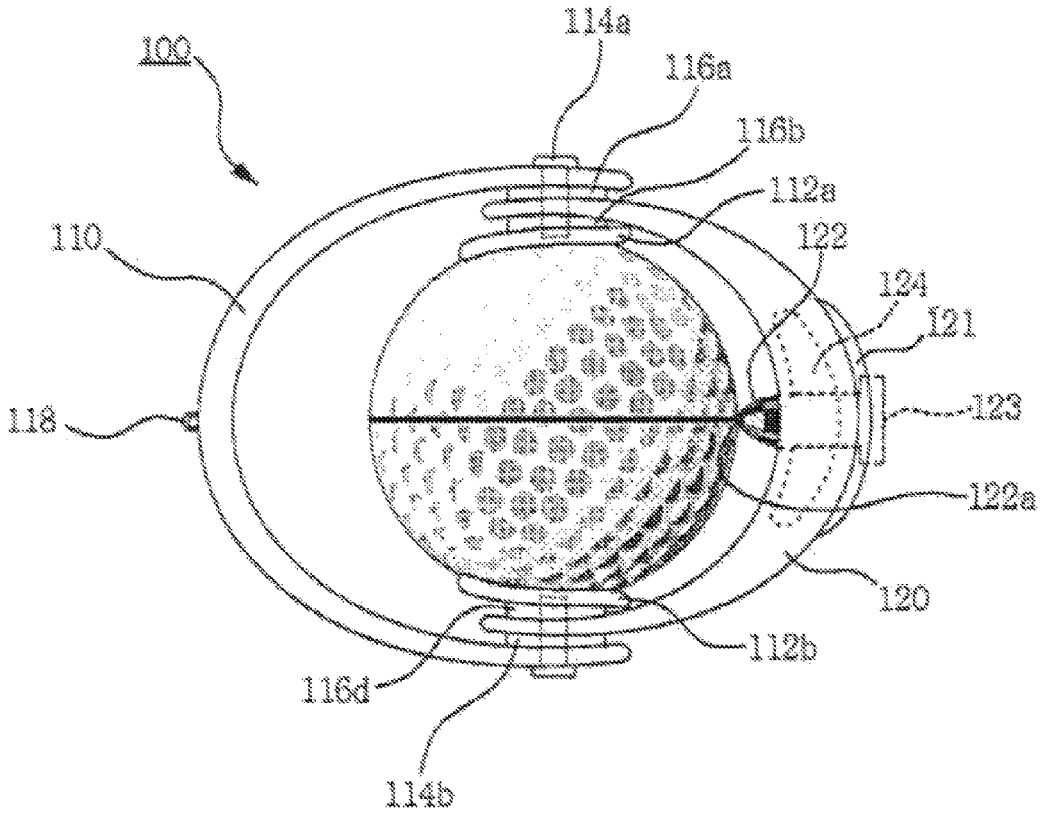
FIG. 4 is a diagram that illustrates drawing a line on a surface of a golf ball using the golf ball liner.

FIGS. 3A and 3B are diagrams that illustrate the golf ball liner of FIG. 1 before inserting the golf ball. FIG. 4 is a diagram that illustrates drawing a line on a surface of a golf ball using the golf ball liner.

Referring to FIGS. 3A, 3B and 4, a user locates a golf ball 10 between the fixing pads 112*a* and 112*b* of the fixing member 110 and rotates the rotating member 120 having the pen 122 along the surface of the golf ball 10 using the both ends of the fixing member 110 as the axis of rotation. Then, the pen 122 draws a line on the surface of the golf ball 10. That is, the golf ball liner 100 according to the embodiments may easily draw a line on the circumference of the golf ball 100 by simply rotating the rotating member 120.

FIGS. 5A and 5B are diagrams that illustrate rotating pens according to embodiments. FIG. 6 is a perspective view of the pen of FIGS. 5A and 5B.

Referring to FIGS. 5A, 5B and 6, the pen 122 is rotatably disposed at the rotating member 120. The pen 122 has a bottom side 122*b* formed in a line shape. Accordingly, the user may control the thickness of the line drawn on the surface of the golf ball 100 by turning the pen 122. For example, a user may draw a comparatively thin line on the golf ball by rotating the bottom end 122*b* of the pen 122. Or a user may draw a comparatively thick line by rotating the pen 122 at 90 degree to locate the bottom end 122*b* of the pen 122.

In another embodiment, the groove 123*a* may be formed on a head 123 of the pen 122 in order to turn the pen 122 of the rotating member 120. A user may turn the pen 122 by turning the head 123 using the groove 123*a* with an additional tool such as a screw driver or a coin.

As described above, the thickness of the line drawn on the golf ball may be controlled by a contacting area of the bottom side 122*b* of the pen 122, which contacts the surface of the golf ball, through rotating the pen 122. That is, since the rotating member 120 regularly rotates in one direction, a user can draw a line with a desired thickness by controlling a position of the bottom side 122*b* of the pen through rotating the pen 122.

In another embodiment, a contact member 123*b* is disposed at the outer surface of the pen in order to make the ink pad 124 of the rotating member 120 to contact the pen when the pen 122 is rotated. Accordingly, ink may be constantly supplied to the pen 122 from the ink pad 124 through the contact member 123*b*. For example, the contact member 123*b* contacts entirely one end surface of the pen 122. In this case, the contact member 123*b* maintains contact between the pen and ink pad 124 when the pen 122 is being rotated. Therefore, ink is supplied to the pen 122 from the ink pad 124.

An elastic member is provided to provide an elastic property. For example, FIG. 5A shows that the coil spring 125 is compressed when the golf ball (not shown) is positioned in the golf ball liner. FIG. 5B shows that the coil spring 125 is compressed less than the coil spring 125 in FIG. 5A. As shown in FIGS. 5A and 5B, the movement of the coil spring 125 makes the pen 122 continuously contact the surface of the golf ball even when the distance between the golf ball liner and the surface of the golf ball varies so that the golf ball liner is able to easily and clearly draw a line even on the irregular surface of the golf ball.

As described above, the golf ball liner according to the embodiments improves ease and accuracy in drawing a line on the surface of a golf ball. Accordingly, a player can easily align the golf ball to a hole-cup during putting or can easily aim the target area during tee shot. Further, the player can use the drawn line as an impact point, thereby improving the directivity of a golf ball.

It is difficult for each player to distinguish his or her own ball from the others' in a golf game where four players generally play together. Since the golf ball liner according to the embodiments permits each user to use own color to draw a line on the golf ball, each player can easily distinguish an own golf ball from others'.

Unlike typical liners, the golf ball liner according to the embodiments includes a pen integrally disposed at the rotating member. Accordingly, it is relatively easy to carry and store the golf ball liner according to the embodiment.

The golf ball liner according to the embodiments does not require a user to separately move a pen or a supplemental member when the user draws a line on the surface of the golf ball. That is, a user inserts the golf ball inside the golf ball liner according to the embodiments. Then, the fixing pads hold tightly the golf ball. The user rotates the rotating member while holding the fixing member to draw a line on the surface of the golf ball. Therefore, it is relatively easy to draw a line on the surface of the golf ball accurately.

While the present invention has been described with respect to the specific embodiments various modifications may be made without departing from the spirit and scope of the invention as defined in the following claims.

What is claimed is:

1. A golf ball liner comprising:

a fixing member having a predetermined shape to house a golf ball;

fixing pads disposed at both ends of the fixing member to hold the golf ball not to move;

a rotating member having a diameter smaller than that of the fixing member, both ends of the rotating member inserted between the fixing member and the fixing pads, the rotating member rotatably supported by the respective ends of the fixing member;

at least one pen disposed at an inner side of the rotating member to contact the golf ball for drawing a line on a surface of the golf ball along a circumference of the golf ball when the rotating member rotates around the golf ball; and an elastic member disposed between the pen and the rotating member to presses the pen toward the golf ball positioned in the golf ball liner, wherein the elastic member is compressed when the golf ball is positioned in the golf ball liner, and a degree of the compression of the elastic member varies according to a shape of a surface of the golf ball to makes the pen continuously contact the surface of the golf ball.

2. The golf ball liner of claim 1, further comprising an ink pad disposed inside the rotating member, wherein the ink pad supplies one of color ink and black ink to the pen.

3. The golf ball liner of claim 1, further comprising an ink pad disposed inside the pen to supply ink to the pen.

4. The golf ball liner of claim 3, wherein the elastic member is positioned between the ink pad and the rotating member.

5. The golf ball liner of claim 3, wherein the elastic member is a coil spring.

6. The golf ball liner of claim 1, wherein the pen includes one end formed in a shape of cone.

7. The golf ball liner of claim 1, wherein the pen is rotatably supported by the rotating member and includes one side formed in a shape of a line.

8. The golf ball liner of claim 7, wherein the pen has a head positioned outside of the golf ball liner, and the head has a groove.

9. The golf ball liner of claim 1, further comprising lubricating pads between the fixing member and the rotating member and between the rotating member and the fixing pad.

10. The golf ball liner of claim 1, wherein the fixing pads are made of rubber material having elastic property to tightly hold the golf ball and form a relatively wide entrance side and a relatively narrow opposite side to easily put the golf ball inside the golf ball liner and to easily take out of the golf ball from the golf ball liner.

11. The golf ball liner of claim 1, wherein the fixing member and the rotating member are made of transparent synthetic resin.

12. The golf ball liner of claim 1, further comprising protrusions formed on an outer surface of the rotating member for preventing sliding.

13. A golf ball liner comprising:

a fixing member to hold the golf ball not to move;

a rotating member rotatably attached to the fixing member;

a pen disposed at an inner side of the rotating member to contact the golf ball for drawing a line on a surface of the golf ball along a circumference of the golf ball when the rotating member rotates around the golf ball; and an elastic member disposed between the pen and the rotating member to presses the pen toward the golf ball positioned in the golf ball liner, wherein the elastic member is compressed when the golf ball is positioned in the golf ball liner, and a degree of the compression of the elastic member varies according to a shape of a surface of the golf ball to makes the pen continuously contact the surface of the golf ball.

14. The golf ball liner of claim 13, wherein the rotating member and the pen are integrally formed.

15. The golf ball liner of claim 13, wherein the elastic member is a coil spring.

16. The golf ball liner of claim 15, wherein the pen has an ink pad inside the pen to provide an ink to the pen, and the coil spring is mounted between the ink pad and the rotating member.

17. The golf ball liner of claim 15, further comprising an ink pad disposed inside the rotating member to provide an ink to the pen.

18. The golf ball liner of claim 13, wherein the pen is rotatably supported by the rotating member, the pen comprises a one end having a shape of a line to be contacted with the golf ball and a head having a groove opposite to said one end.

* * * * *